US011588256B2

(12) United States Patent
Latorre et al.

(10) Patent No.: US 11,588,256 B2
(45) Date of Patent: Feb. 21, 2023

(54) POWER INPUT TERMINAL BLOCK

(71) Applicant: TE Connectivity Services GmbH, Schaffhausen (CH)

(72) Inventors: Justin Latorre, Harrisburg, PA (US); Matthew Edward Mostoller, Hummelstown, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/140,339

(22) Filed: Jan. 4, 2021

(65) Prior Publication Data

US 2021/0234288 A1 Jul. 29, 2021

Related U.S. Application Data

(60) Provisional application No. 62/966,732, filed on Jan. 28, 2020.

(51) Int. Cl.

| | |
|---|---|
| ***H01R 4/48*** | (2006.01) |
| ***H01R 9/24*** | (2006.01) |
| *H01R 4/36* | (2006.01) |

(52) U.S. Cl.

CPC ..... *H01R 4/4836* (2013.01); *H01R 9/2416* (2013.01); *H01R 4/36* (2013.01)

(58) Field of Classification Search

None

See application file for complete search history.

(56) References Cited

U.S. PATENT DOCUMENTS 5,368,506 A * 11/1994 Heimbrock ..... H01R 4/36 439/709
6,074,121 A * 6/2000 Medeiros ..... H01R 4/302 403/12
6,689,955 B2 * 2/2004 Doutaz ..... H01R 4/4836 174/135
6,783,385 B2 * 8/2004 Rudy ..... H01R 4/4836 439/438
9,419,352 B2 8/2016 Hyder (Continued)

FOREIGN PATENT DOCUMENTS

CN 202 616 433 U 12/2012
GB 2 059 191 A 4/1981

OTHER PUBLICATIONS

International Search Report, International Application No. PCT/IB2021/050592, International Filing Date, Jan. 26, 2021.

*Primary Examiner* — Ross N Gushi

(57) ABSTRACT

A power input terminal block includes terminals received in terminal channels of a housing each having a main body defining a wire pocket receiving a supply wire and a take-off tab electrically connected to the main body. The power input terminal block includes clamp contacts coupled to the take-off tabs each having a base, a spring beam extending from the base, and a cap extending from the spring beam having a poke-in window configured to receive a take-off wire. An edge defining the poke-in window engages the take-off wire and pulls the take-off wire against the wire side of the take-off tab. The power input terminal block includes release levers coupled to the housing to move the spring beam to an extended position to allow loading and removal of the take-off wire from the clamp contact and the take-off tab.

19 Claims, 13 Drawing Sheets

(56) References Cited

U.S. PATENT DOCUMENTS

| | | | |
|---|---|---|---|
| 9,466,897 | B1 | 10/2016 | Wu |
| 2003/0008569 | A1 | 1/2003 | Matsumoto et al. |
| 2016/0028170 | A1 | 1/2016 | Hyder |

* cited by examiner

POWER INPUT TERMINAL BLOCK

CROSS REFERENCE TO RELATED APPLICATIONS

This application claims benefit to U.S. Provisional Application No. 62/966,732, filed 28 Jan. 2020, titled "POWER INPUT TERMINAL BLOCK", the subject matter of which is herein incorporated by reference in its entirety.

BACKGROUND OF THE INVENTION

The subject matter herein relates generally to power input terminal blocks.

Power input terminal blocks are used to distribute power in a system, such as a lighting system. For example, streetlights use power input terminal blocks to distribute power within the light fixture from the main supply wires to take-off wires used to power light fixture components, such as the driver, the light element, and the like. Conventional power input terminal blocks use threaded terminal lugs with set screws to connect the line, ground and neutral wires. Separate male tab contacts extend from the threaded terminal lug. Female tab terminals are connected to the male tab contacts by pressing the female tab terminals onto the male tab contacts. The female tab terminals are crimped to ends of the take-off wires. The female tab terminals occupy space within the power input terminal block and add cost and complexity to the assembly process.

A need remains for a cost effective and reliable power input terminal block.

BRIEF DESCRIPTION OF THE INVENTION

In one embodiment, a power input terminal block is provided. The power input terminal block includes a housing including terminal channels with separating walls between the terminal channels. Terminals are received in the terminal channels. Each terminal includes a main body defining a wire pocket and a set screw wall adjacent the wire pocket holding a set screw movably received in the wire pocket to retain a supply wire in the wire pocket. Each terminal includes a take-off tab electrically connected to the main body. The take-off tab has a wire side configured to receive a take-off wire. The power input terminal block includes clamp contacts coupled to the take-off tabs of the corresponding terminals. Each clamp contact has a base coupled to the take-off tab and a spring beam extending from the base. Each clamp contact has a cap extending from the spring beam. The cap includes a poke-in window configured to receive the take-off wire. The cap includes an edge defining the poke-in window. The edge engages the take-off wire and pulls the take-off wire against the wire side of the take-off tab. The power input terminal block includes release levers coupled to the housing. Each release lever includes a releasing surface operably coupled to the spring beam of the corresponding clamp contact to move the spring beam to an extended position to allow loading and removal of the take-off wire from the clamp contact and the take-off tab.

In another embodiment, a power input terminal block is provided. The power input terminal block include a housing including terminal channels with separating walls between the terminal channels. Terminals are received in the terminal channels. Each terminal is stamped and formed from a terminal body to include a main body and a take-off tab. The main body defines a wire pocket and a set screw wall adjacent the wire pocket holding a set screw movably received in the wire pocket to retain a supply wire in the wire pocket. The take-off tab has a wire side configured to receive a take-off wire. The take-off tab is integral with the main body as a monolithic, unitary structure. The power input terminal block includes clamp contacts coupled to the take-off tabs of the corresponding terminals. Each clamp contact has a base coupled to the take-off tab and a spring beam extending from the base. Each clamp contact has a cap extending from the spring beam. The cap includes a poke-in window configured to receive the take-off wire. The cap includes an edge defining the poke-in window. The edge engages the take-off wire and pulls the take-off wire against the wire side of the take-off tab. The power input terminal block includes release levers coupled to the housing. Each release lever includes a releasing surface operably coupled to the spring beam of the corresponding clamp contact to move the spring beam to an extended position to allow loading and removal of the take-off wire from the clamp contact and the take-off tab.

In a further embodiment, a power input terminal block is provided. The power input terminal block includes a housing including terminal channels with separating walls between the terminal channels. Terminals are received in the terminal channels. Each terminal includes a main body defining a wire pocket and a set screw wall adjacent the wire pocket holding a set screw movably received in the wire pocket to retain a supply wire in the wire pocket. Each terminal includes a take-off tab electrically connected to the main body. The take-off tab has a wire side configured to receive a plurality of take-off wires. The power input terminal block includes clamp contacts coupled to the take-off tabs of the corresponding terminals. Each clamp contact has a base coupled to the take-off tab and a plurality of spring beams extending from the base. The spring beams have caps at distal ends of the spring beams. The caps includes poke-in windows configured to receive the take-off wires. The poke-in windows are defined by wire edges that are configured to engage the take-off wires and pull the take-off wires against the wire side of the take-off tab. The base of each clamp contact electrically commons the corresponding take-off wires. The power input terminal block includes release levers coupled to the housing. Each release lever includes a releasing surface operably coupled to the spring beams of the corresponding clamp contacts to move the spring beams to extended positions to allow loading and removal of the take-off wires from the clamp contacts and the take-off tabs.

DETAILED DESCRIPTION OF THE INVENTION

Figure 1:
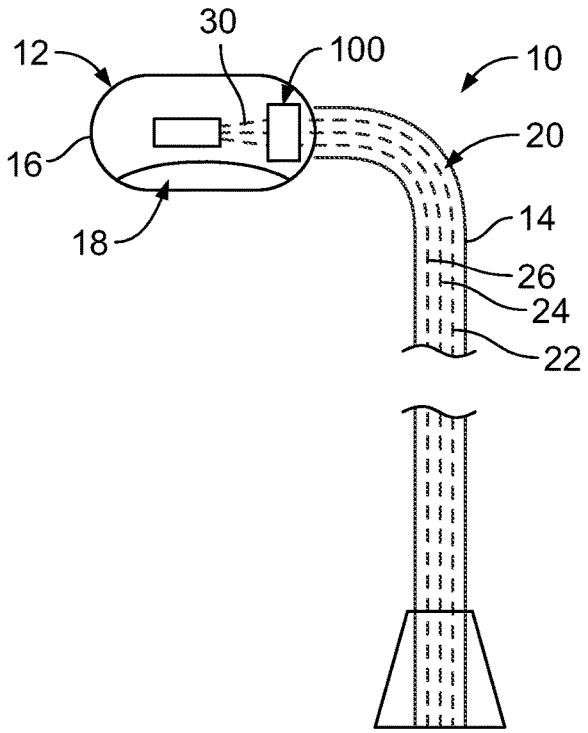
FIG. 1 illustrates a streetlight having a power input terminal block in accordance with an exemplary embodiment.

FIG. 1 illustrates a streetlight 10 having a power input terminal block 100 in accordance with an exemplary embodiment. The streetlight 10 includes a light fixture 12 mounted to a pole 14. The light fixture 12 includes a fixture housing 16 and a light assembly 18 within the fixture housing 16. Supply wires 20 are used to supply electrical power to the light assembly 18 for operating the lighting assembly 18. The supply wires 20 pass through the interior of the pole 14 to the power input terminal block 100. The supply wires 20 may include a power wire 22 a ground wire 24 and a neutral wire 26. The supply wires 20 supply electrical power to the light assembly 18, such as for powering a light, a driver assembly, and the like of the light assembly 18. In the illustrated embodiment, the power input terminal block 100 is provided in the light fixture 12. However, the power input terminal block 100 may be provided in the pole 14, such as at the top or at the bottom in alternative embodiments.

The power input terminal block 100 may be used in other applications other than the streetlight 10 in alternative embodiments. For example, the power input terminal block 100 may be used in a building power system, in an industrial power system, in a vehicle power system, and the like.

Figure 2:
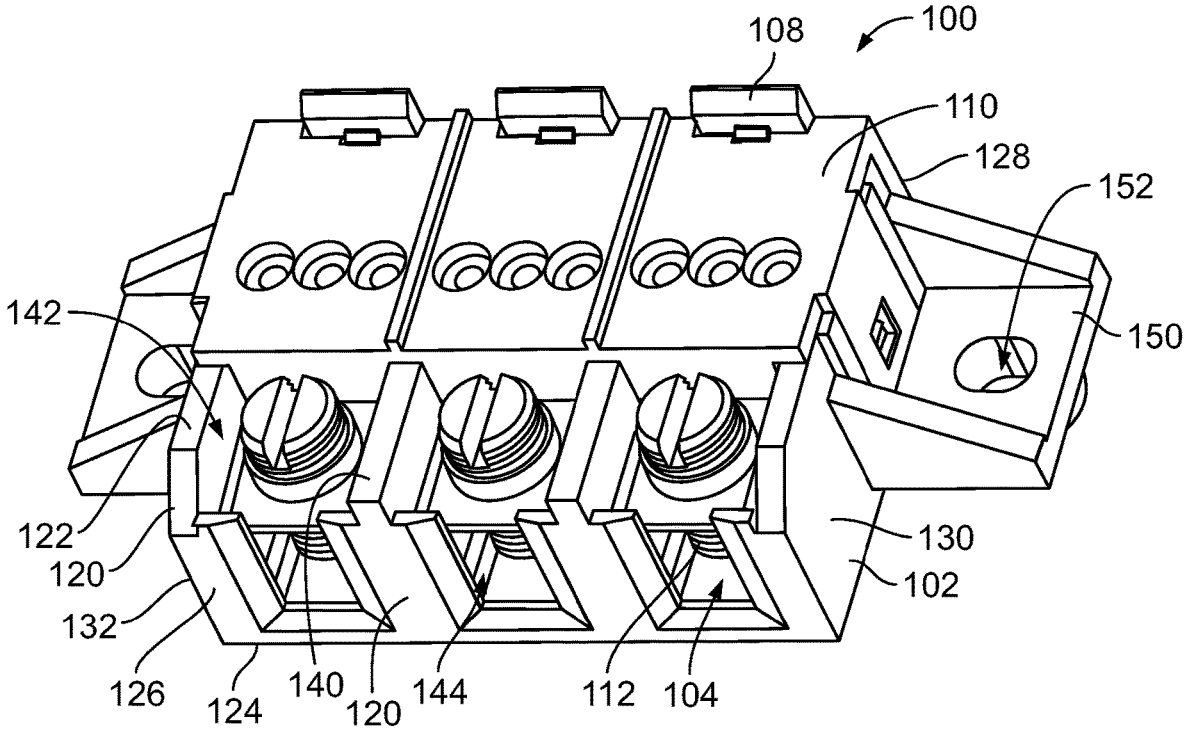
FIG. 2 is a top perspective view of the power input terminal block in accordance with an exemplary embodiment.

FIG. 2 is a top perspective view of the power input terminal block 100 in accordance with an exemplary embodiment. The power input terminal block 100 includes a housing 102, terminals 104, clamp contacts 106, release levers 108, and a cover 110 coupled to the housing 102 covering the terminals 104, the clamp contacts 106, and/or the release levers 108.

In an exemplary embodiment, the power input terminal block 100 is configured to receive the supply wires 20 (shown in FIG. 1) and is configured to receive take-off wires 30 used to power other components within the light fixture 12 (shown in FIG. 1). The take-off wires 30 may be smaller gage wires than the supply wires 20. In an exemplary embodiment, the take-off wires 30 are configured to be poked into the power input terminal block 100 for quick assembly and electrical connection. As such, the take-off wires 30 are separable from the power input terminal block 100, such as for rewiring, repair, or replacement. The take-off wires 30 may be quickly and easily connected to the power input terminal block 100. In an exemplary embodiment, the release levers 108 are used to release the clamp contacts 106 to allow insertion and removal of the take-off wires 30 without damaging the take-off wires 30 or other components of the power input terminal block 100, such as the clamp contacts 106 and/or the terminals 104. In the illustrated embodiment, the take-off wires 30 are loaded through openings in the cover 110 for termination to the clamp contacts 106 in the terminals 104. Optionally, each terminal 104 is used to power multiple take-off wires 30.

The housing 102 includes a plurality of walls 120 defining the housing 102. The housing 102 extends between a top 122 and a bottom 124. The housing 102 includes a front 126 and the rear 128. The housing 102 includes a first side 130 and a second side 132 opposite the first side 130. The walls 120 may include a top wall, a bottom wall, a front wall, a rear wall, a first side wall, a second side wall, or other walls.

In an exemplary embodiment, the housing 102 includes separating walls 140 separating terminal channels 142 that receive corresponding terminals 104. The terminal channels 142 may be open at the top 122 and/or the front 126 to receive the terminals 104. In an exemplary embodiment, the cover 110 is coupled to the top 122 of the housing 102 to close the terminal channels 142 and retain the terminals 104 in the terminal channels 142. In an exemplary embodiment, the housing 102 includes wire openings 144 at the front 126 that receive corresponding supply wires 20. The supply wires 20 may be loaded through the wire openings 144 into the terminals 104. The supply wires 20 may be mechanically and electrically connected to the terminals 104 using set screws 112

In an exemplary embodiment, the housing 102 includes mounting tabs 150 used for mounting the power input terminal block 100 to a structure, such as the fixture housing 16 (shown in FIG. 1). In the illustrated embodiment, the mounting tabs 150 are provided at the first side 130 and the second side 132. Other positions are possible in alternative embodiments, such as the bottom 124, the front 126 and/or the rear 128. Each mounting tab 150 includes an opening 152 configured to receive a fastener (not shown), such as a threaded fastener. The mounting tabs 150 may be secured to the mounting structure by other means in alternative embodiments.

Figure 3:
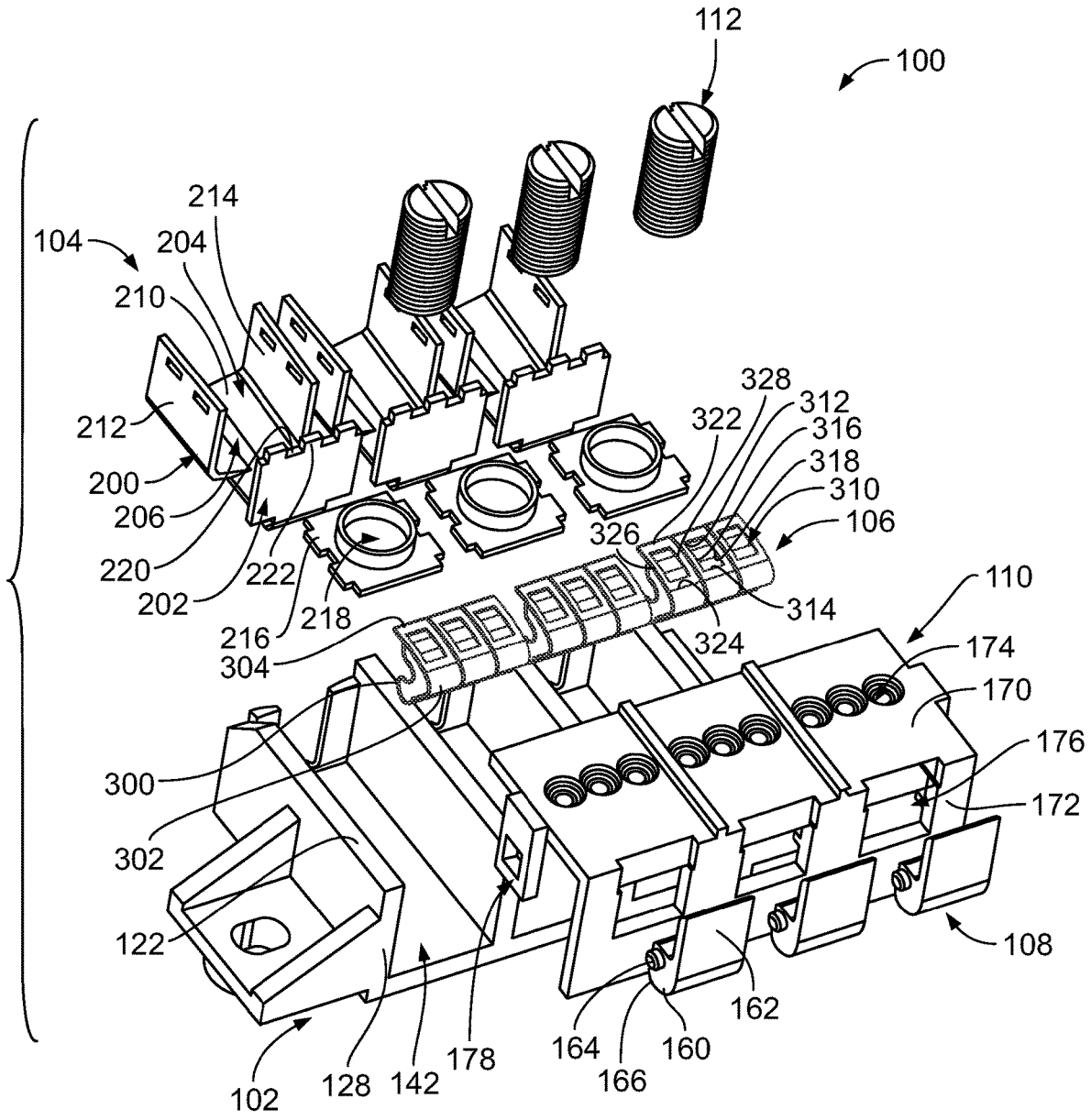
FIG. 3 is a front exploded view of the power input terminal block in accordance with an exemplary embodiment.

FIG. 3 is a rear exploded view of the power input terminal block 100 in accordance with an exemplary embodiment. FIG. 3 illustrates the housing 102, the terminals 104, the clamp contacts 106, the release levers 108, and the cover 110. The terminals 104 in the clamp contacts 106 are configured to be loaded into the housing 102 through the top 122 of the housing 102.

In an exemplary embodiment, each of the terminals 104 are identical; however, the terminals 104 may include different features in alternative embodiments. Each terminal 104 includes a main body 200 and a take-off tab 202 extending from the main body 200. The main body 200 defines a wire pocket 204 configured to receive corresponding supply wire 20. In an exemplary embodiment, the main body 200 includes an end wall 210, a first side wall 212, and a second side wall 214. The side walls 212, 214 extend from the end wall 210. In an exemplary embodiment, the main body 200 is stamped and formed. For example, the side walls 212, 214 are integral with the end wall 210, being a monolithic, unitary structure. The side walls 212, 214 are bent or folded from the end wall 210. In an exemplary embodiment, the end wall 210 and the side walls 212, 214 have a common wall thickness, being stamped from a metal sheet of material. In various embodiments, the end wall 210 is nonplanar forming a cradle 206 at the bottom of the wire pocket 204 that receives the supply wire 20. The cradle 206 helps to center the supply wire 20 in the wire pocket 204.

In an exemplary embodiment, the terminal 104 includes a set screw wall 216 having a set screw opening 218 that receives the set screws 112. The set screw opening 218 may be a threaded bore in various embodiments. The set screws 112 may be tightened into the wire pocket 204 by rotating the set screws 112, such as to mechanically and electrically connect to the supply wire 20. In the illustrated embodiment, the set screws wall 216 is separate and discrete from the main body 200. The set screws wall 216 is configured to be coupled to the side walls 212, 214 at the top edges of the side walls 212, 214, opposite the end wall 210. In alternative embodiments, the set screws wall 216 may be integral with the end wall 210 and the side walls 212, 214 as part of the main body 200.

The take-off tab 202 extends rearward from the main body 200. For example, the take-off tab 202 may extend from the end wall 210, being bent or formed to be an upstanding take-off tab 202. In various embodiments, the take-off tab 202 may be perpendicular to the end wall 210 and perpendicular to the side walls 212, 214. For example, the take-off tab 202 may be oriented perpendicular to the loading direction of the supply wire 20 into the wire pocket 204. In an exemplary embodiment, the take-off tab 202 is integral with the main body 200. In an exemplary embodiment, the terminal 104 is a monolithic, unitary structure. In an exemplary embodiment, the take-off tab 202 extends to an outer edge 220. The take-off tab 202 includes one or more contact locating fingers 222 extending from the outer edge 220. The contact locating fingers 222 are configured to be received in the clamp contacts 106, such as in poke-in windows of the clamp contacts 106.

In an exemplary embodiment, each clamp contact 106 is identical. However, the clamp contacts 106 may have different features in alternative embodiments. Each clamp contact 106 includes a base 300, one or more spring beams 302 extending from the base 300, and one or more caps 304 extending from the corresponding spring beams 302. The base 300 is configured to be coupled to the terminal 104, such as the take-off tab 202. The base 300 may have multiple points of contact with the take-off tab 202. Each cap 304 is used to mechanically and electrically connect to the corresponding take-off wire 30. For example, the take-off wires 30 may be poked into the caps 304. The spring beams 302 allow the caps 304 to move relative to the base 300 for mating to and unmated from the take-off wires 30. In the illustrated embodiment, the clamp contact 106 includes three spring beams 302 and three caps 304 are provided at the ends of the spring beams 302. The spring beams 302 are independently movable relative to each other. The spring beams 302 are deflectable, such as to release the clamp contact 106 from the take-off wires 30.

In an exemplary embodiment, the clamp contact 106 are configured to be clipped onto the take-off tabs 202. The base 300 is configured to be electrically connected to the take-off tab 202. In an exemplary embodiment, each cap 304 includes a poke-in window 310 that receives the corresponding take-off wire 30. The take-off wire 30 is releasably received in the poke-in window 310. The cap 304 may be released from the take-off wire 30 to allow the take-off wire 30 to be removed from the power input terminal block 100. For example, the release lever 108 may be used to release the cap 304 from the take-off wire 30. The poke-in window 310 is defined by edges, such as a front edge 312, a rear edge 314 and side edges 316, 318. When the clamp contact 106 is clamped to the take-off wire 30, the front edge 312 presses against the take-off wire 30 to electrically connect the clamp contact 106 to the take-off wire 30. The take-off wire 30 is configured to be pressed against the take-off tab 202 by the front edge 312 of the poke-in window 310. The cap 304 includes a front portion 322 forward of the poke-in window 310, a rear portion 324 rearward of the poke-in window 310, and side rails 326, 328 extending along the side edges 316, 318.

In an exemplary embodiment, each release lever 108 is identical; however, the release levers 108 may include different features in alternative embodiments. In an exemplary embodiment, the release levers 108 are configured to be coupled to the cover 110. For example, the release levers 108 may be rotatably coupled to the cover 110. Each release lever 108 includes a main body 160 and a handle 162 extending from the main body 160. The handle 162 is configured to be actuated to move the main body 160 into contact with the clamp contact 106 to release the clamp contact 106. For example, the handle 162 may be rotated about axels 164 extending from the sides of the main body 160 to rotate the main body 160 into contact with the clamp contact 106. In an exemplary embodiment, the main body 160 includes a releasing surface 166 configured to engage the clamp contact 106 and release the clamp contact 106.

The cover 110 is configured to be coupled to the housing 102. In an exemplary embodiment, the cover 110 includes a main wall 170 and an end wall 172 extending from the main wall 170. The main wall 170 is configured to extend across the top 122 of the housing 102. The end wall 172 is configured to extend along the rear 128 of the housing 102. The main wall 170 and the end wall 172 close the terminal channels 142 to retain the terminals 104 in the terminal channels 142. The main wall 170 and/or the end wall 172 may be used to retain the clamp contact 106 in the terminal channels 142. In an exemplary embodiment, the cover 110 includes poke-in wire openings 174 in the main wall 170. The poke-in wire openings 174 receive corresponding take-off wires 30 as the take-off wires 30 are poked into the power input terminal block 100. The poke-in wire openings 174 are configured to be aligned with corresponding clamp contact 106 and poke-in windows 310 to receive the take-off wires 30. In an exemplary embodiment, the cover 110 includes windows 176 at the end wall 172 that receive corresponding release levers 108. The release levers 108 may be rotatably coupled to the end wall 172. In an exemplary embodiment, the cover 110 includes latches 178 configured to be coupled to the housing 102 to secure the cover 110 to the housing 102. Other securing means, such as fasteners, may be used in alternative embodiments.

Figure 4:
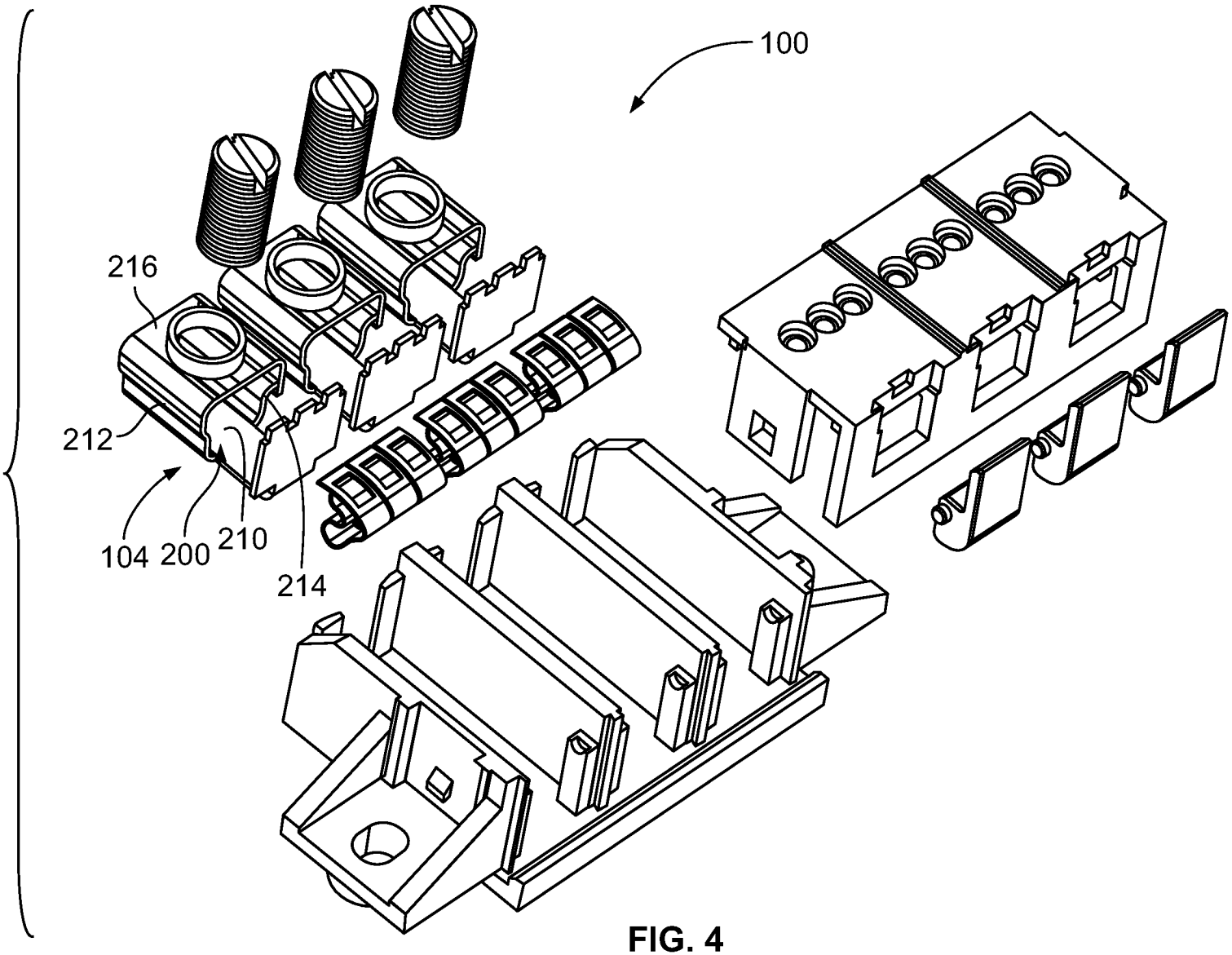
FIG. 4 is a front exploded view of the power input terminal block in accordance with an exemplary embodiment.

FIG. 4 is a rear exploded view of the power input terminal block 100 in accordance with an exemplary embodiment. FIG. 4 illustrates the terminals 104 having the set screw wall 216 formed integral with the end wall 210 and the side walls 212, 214. The set screw wall 216 is an integral part of the main body 200. For example, the end wall 210, the side walls 212, 214, and the set screw wall 216 are a monolithic, unitary structure. In an exemplary embodiment, the end wall 210, the side walls 212, 214, and the set screw wall 216 have a common wall thickness, being stamped from a metal sheet of material.

Figure 5:
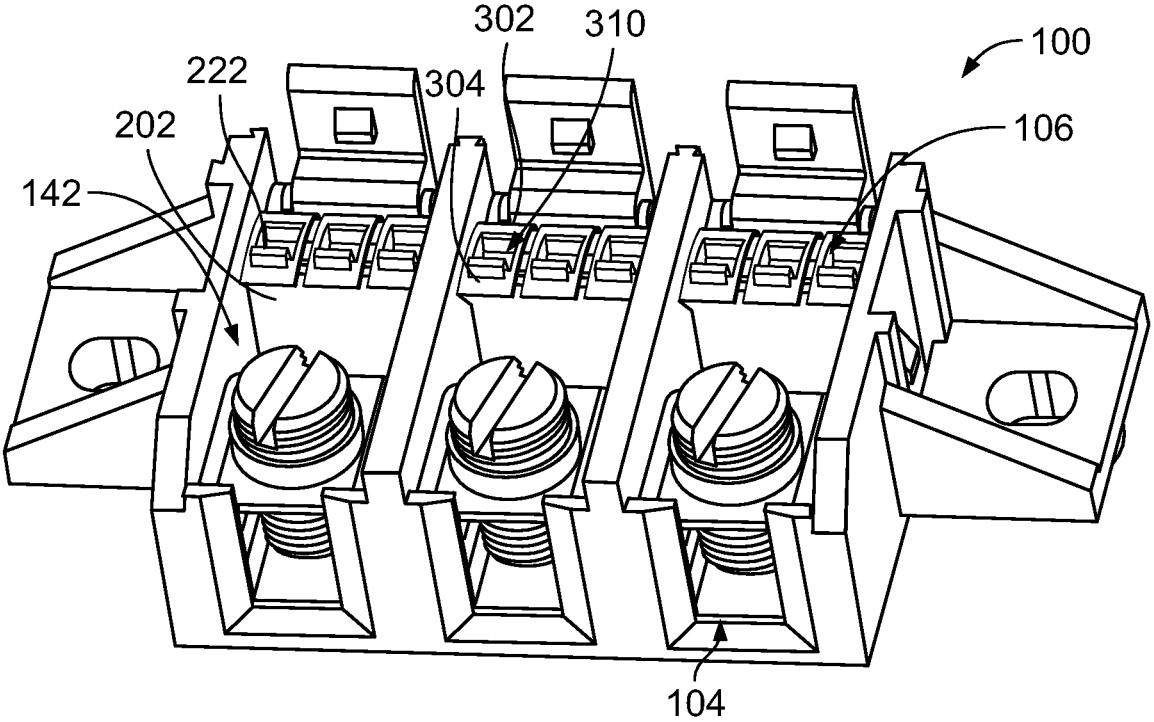
FIG. 5 is a top perspective view of a portion of the power input terminal block in accordance with an exemplary embodiment.
Figure 6:
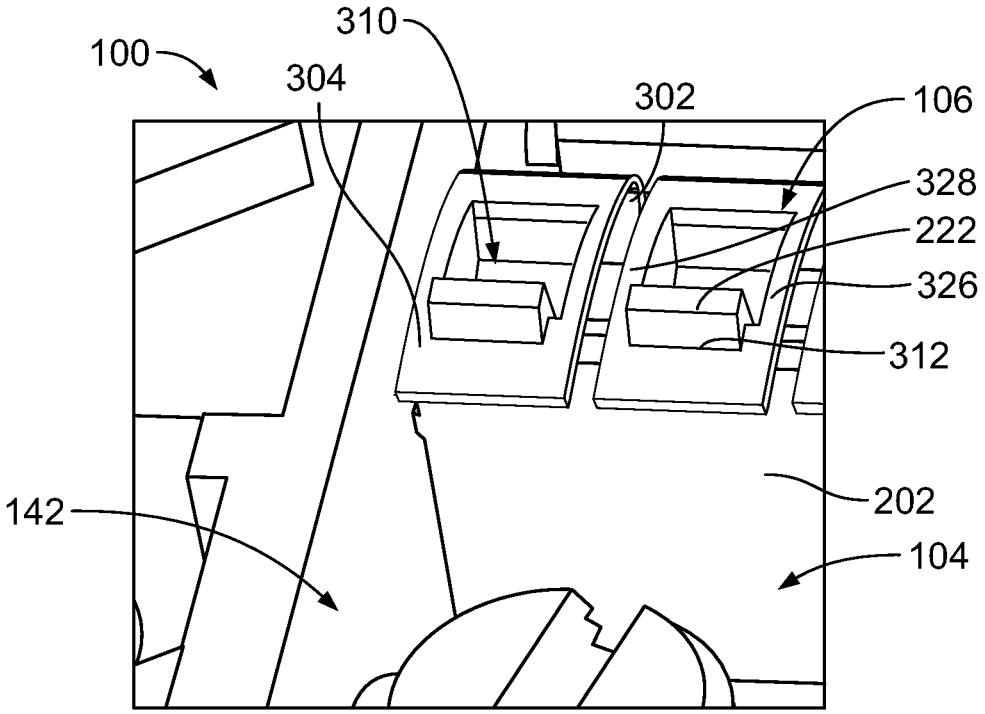
FIG. 6 is an enlarged view of a portion of the power input terminal block in accordance with an exemplary embodiment.

FIG. 5 is a top perspective view of a portion of the power input terminal block 100 with the cover 110 (shown in FIG. 3) removed to illustrate the components of the power input terminal block 100. FIG. 6 is an enlarged view of a portion of the power input terminal block 100. When assembled, the terminals 104 are received in the terminal channel 142. The clamp contacts 106 are coupled to the take-off tabs 202 of the terminals 104. For example, the clamp contacts 106 may be clipped onto the take-off tabs 202. In other various embodiments, the clamp contacts 106 may be soldered or welded to the take-off tabs 202. In an exemplary embodiment, the clamp contacts 106 are coupled to the take-off tabs 202 such that the contact locating fingers 222 extend into the poke-in windows 310. The spring beams 302 pull the caps 304 rearward such that the front edges 312 are pulled against the contact locating fingers 222. The side rails 326, 328 extend along sides of the contact locating fingers 222 to center or position the caps 304 relative to the take-off tab 202, such as to position the poke-in windows 310 in alignment with the poke-in wire openings 174.

Figure 7:
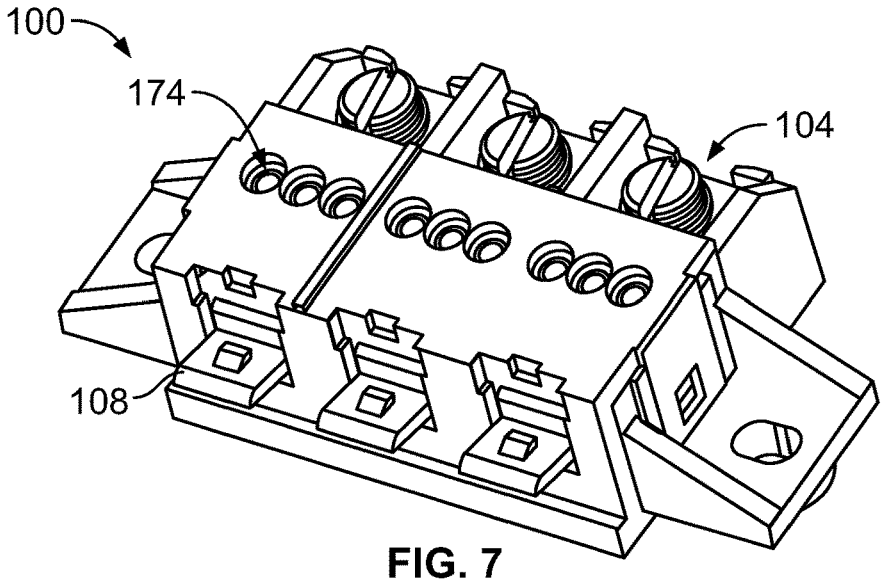
FIG. 7 illustrates the power input terminal block during assembly of the take-off wires in accordance with an exemplary embodiment.
Figure 8:
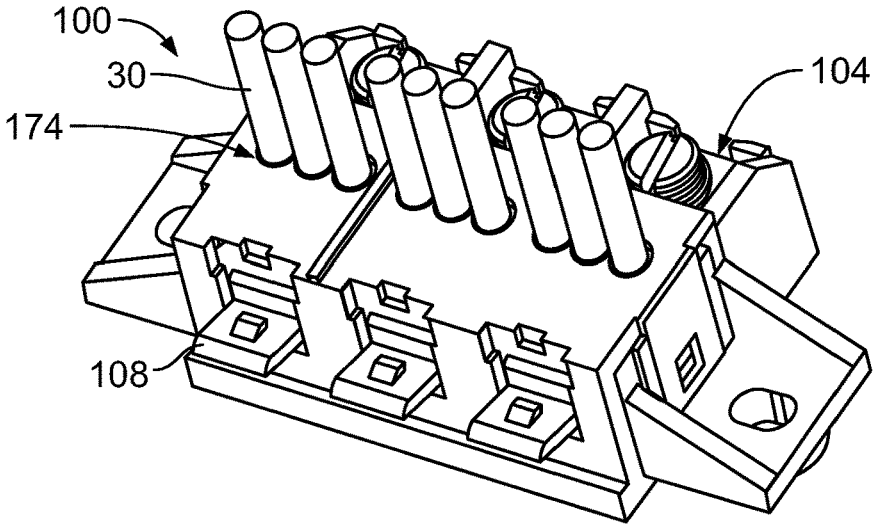
FIG. 8 illustrates the power input terminal block during assembly of the take-off wires in accordance with an exemplary embodiment.
Figure 9:
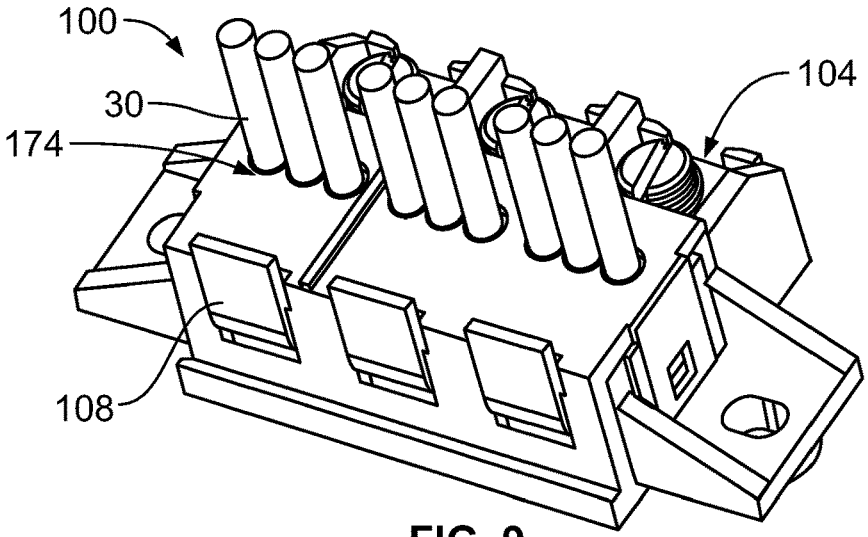
FIG. 9 illustrates the power input terminal block during assembly of the take-off wires in accordance with an exemplary embodiment.

FIGS. 7-9 illustrates the power input terminal block 100 during assembly of the take-off wires 30 in accordance with an exemplary embodiment. FIG. 7 illustrates the power input terminal block 100 prior to the take-off wires 30 the loaded into the poke-in wire openings 174. FIG. 8 illustrates the power input terminal block 100 with the take-off wires 30 partially loaded into the poke-in wire openings 174. FIG. 9 illustrates the power input terminal block 100 in an assembled state with the take-off wires 30 fully loaded into the poke-in wire openings 174.

As shown in FIG. 7, prior to loading the take-off wires 30 into the power input terminal block 100, the release levers 108 are actuated to open the clamp contact 106 and align the poke-in windows 310 (shown in FIG. 3) with the poke-in wire openings 174. As such, the take-off wires 30 have free access into the power input terminal block 100 without interference from the clamp contact 106, which reduces damage to the take-off wires 30. For example, the take-off wires 30 may be stranded wires and releasing the clamp contact 106 reduces the chance of bending the individual strands of the take-off wires 30 at the take-off wires 30 are poked into the power input terminal block 100.

As shown in FIG. 8, during loading of the take-off wires 30 into the power input terminal block 100, the release levers 108 remain actuated to hold the clamp contact 106 open. As shown in FIG. 9, after the take-off wires 30 are loaded into the power input terminal block 100, the release levers 108 are released allowing the clamp contact 106 to close around the take-off wires 30. With the release levers 108 unactuated, the clamp contact 106 are allowed to engage the take-off wires 30 to mechanically and electrically connect the take-off wires 30 to the clamp contact 106 and the terminals 104.

Figure 10:
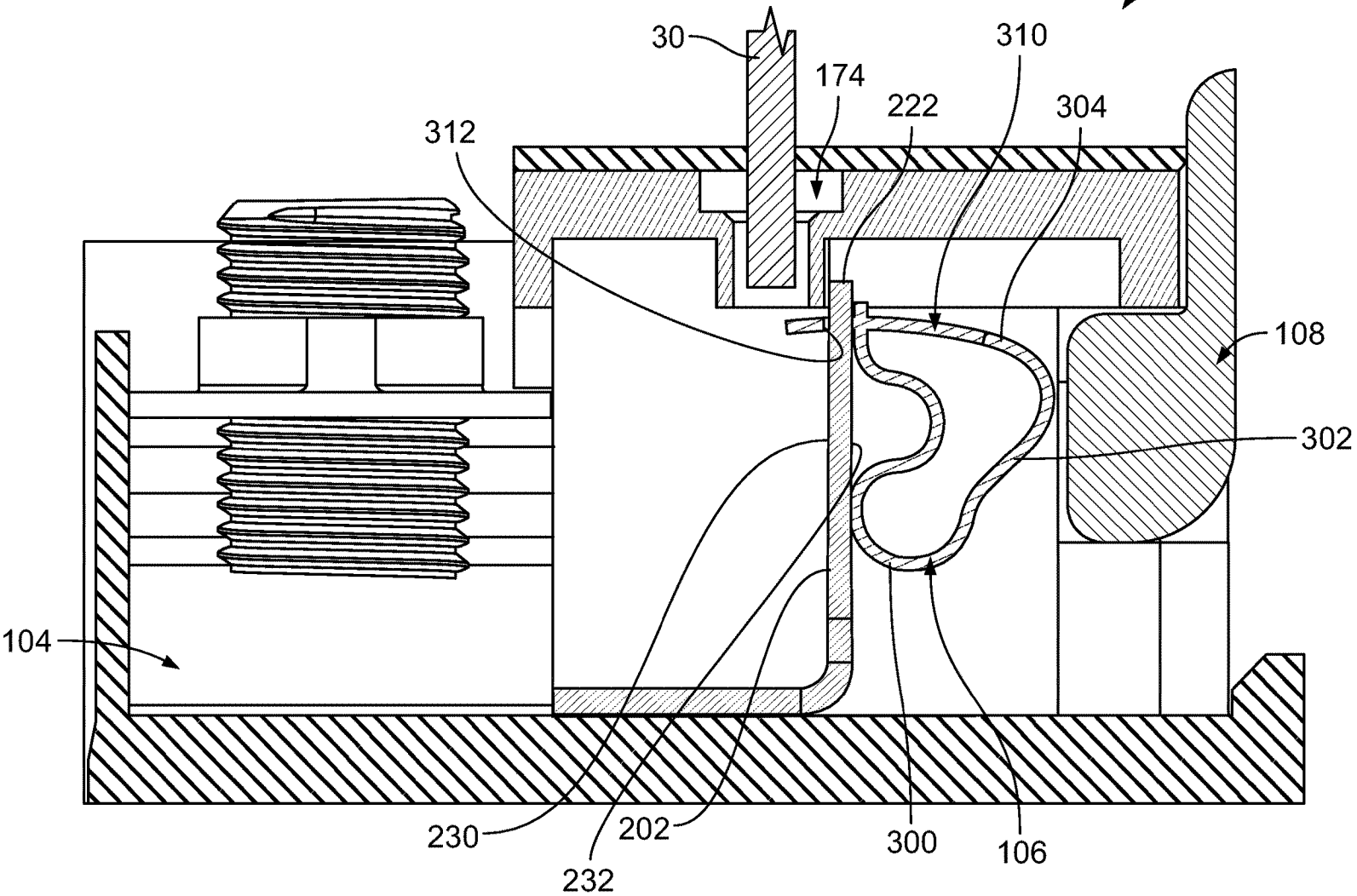
FIG. 10 is a cross-sectional view of a portion of the power input terminal block in accordance with an exemplary embodiment.

FIG. 10 is a cross-sectional view of a portion of the power input terminal block 100 showing one of the take-off wires 30 partially loaded into the power input terminal block 100. The take-off wires 30 is received in the poke-in wire opening 174. The release lever 108 is unactuated, leaving the clamp contact 106 in a blocking position such that the take-off wires 30 is unable to be loaded into the power input terminal block 100. The poke-in the window 310 of the clamp contact 106 is offset or unaligned with the poke-in wire opening 174. The release lever 108 needs to be actuated to deflect the spring beam 302 and move the cap 304 forward to align the poke-in window 310 with the poke-in wire opening 174.

FIG. 10 illustrates the power input terminal block 100 with the clamp contact 106 coupled to the terminal 104. The base 300 is coupled to the take-off tab 202. In an exemplary embodiment, the take-off tab 202 includes a wire side 230 and eight contact side 232 opposite the wire side 230. The base 300 is coupled to the contact side 232. Optionally, all the base 300 may be coupled to the contact side 232 at multiple points of contact. The spring beam 302 extends rearward of the take-off tab 202, such as toward the release lever 108. The cap 304 extends forward from the spring beam 302 to a distal end of the clamp contact 106. The contact locating fingers 222 of the take-off tab 202 extend through the poke-in window 310 to locate the clamp contact 106 relative to the terminal 104. The spring beam 302 pulls the cap 304 rearward until the front edge 312 of the poke-in window 310 is pulled against the contact locating finger 222. The clamp contact 106 may be released from the contact locating finger 222 by pressing the spring beam 302 in a forward direction using the release lever 108.

Figure 11:
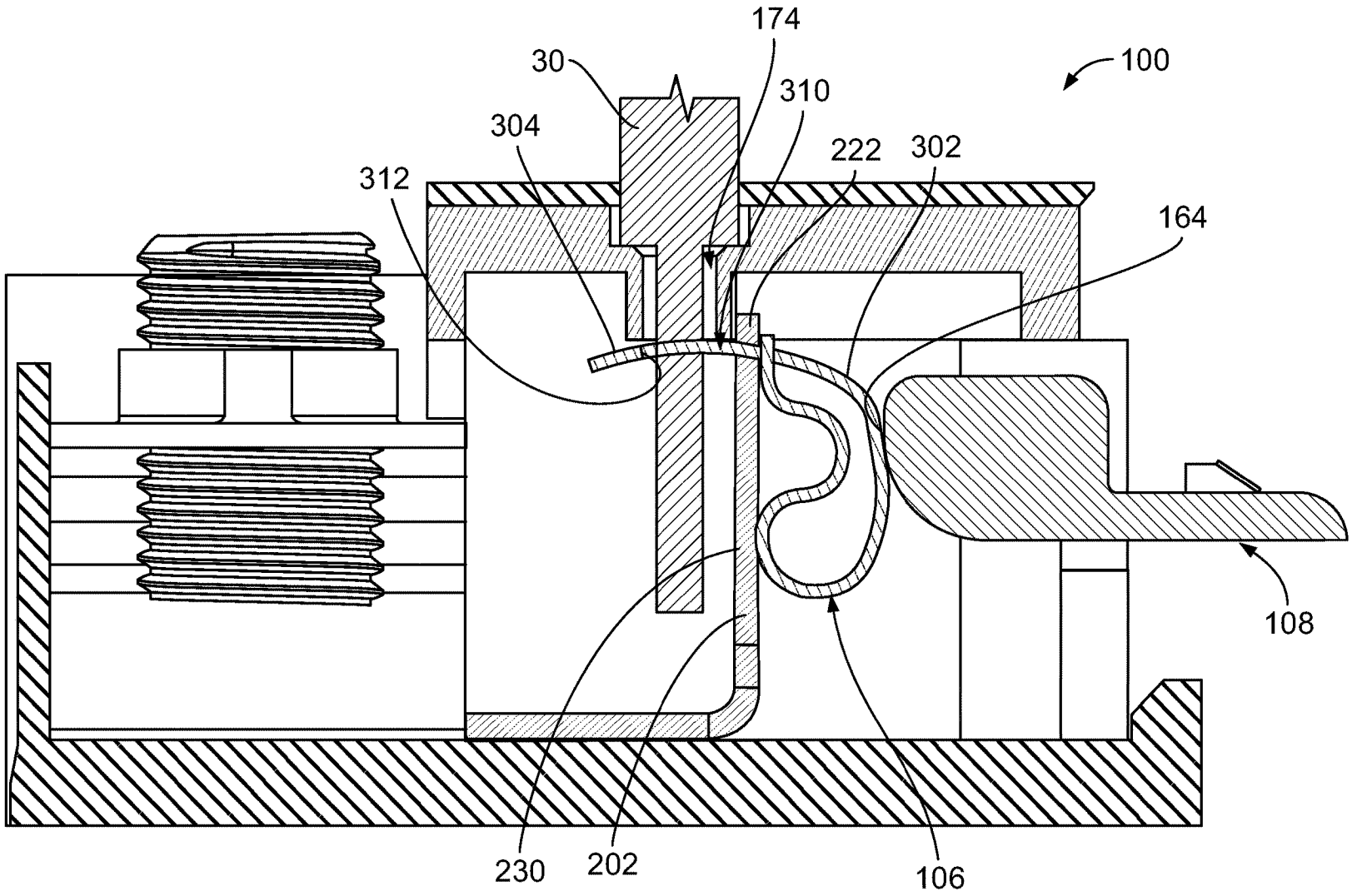
FIG. 11 is a cross-sectional view of a portion of the power input terminal block in accordance with an exemplary embodiment.

FIG. 11 is a cross-sectional view of a portion of the power input terminal block showing the take-off wire 30 poked into the power input terminal block 100. The release lever 108 is illustrated in an actuated position engaging the spring beam 302 of the clamp contact 106. The releasing surface 166 is rotated against the spring beam 302 to push the spring beam 302 and the cap 304 forward to a released position. The poke-in window 310 is aligned with the poke-in wire opening 174. The front edge 312 is moved forward away from the contact locating finger 222 allowing the take-off wires 30 to be loaded into the poke-in window 310. The take-off wire 30 passes through the poke-in window 310 and extends along the wire side 230 of the take-off tab 202. The releasing surface 166 is configured to be operably coupled to the spring beam 302 of the clamp contact 106 to move the spring beam 302 to an extended position to allow loading and removal of the take-off wire from the clamp contact 106 and the take-off tab 202.

Figure 12:
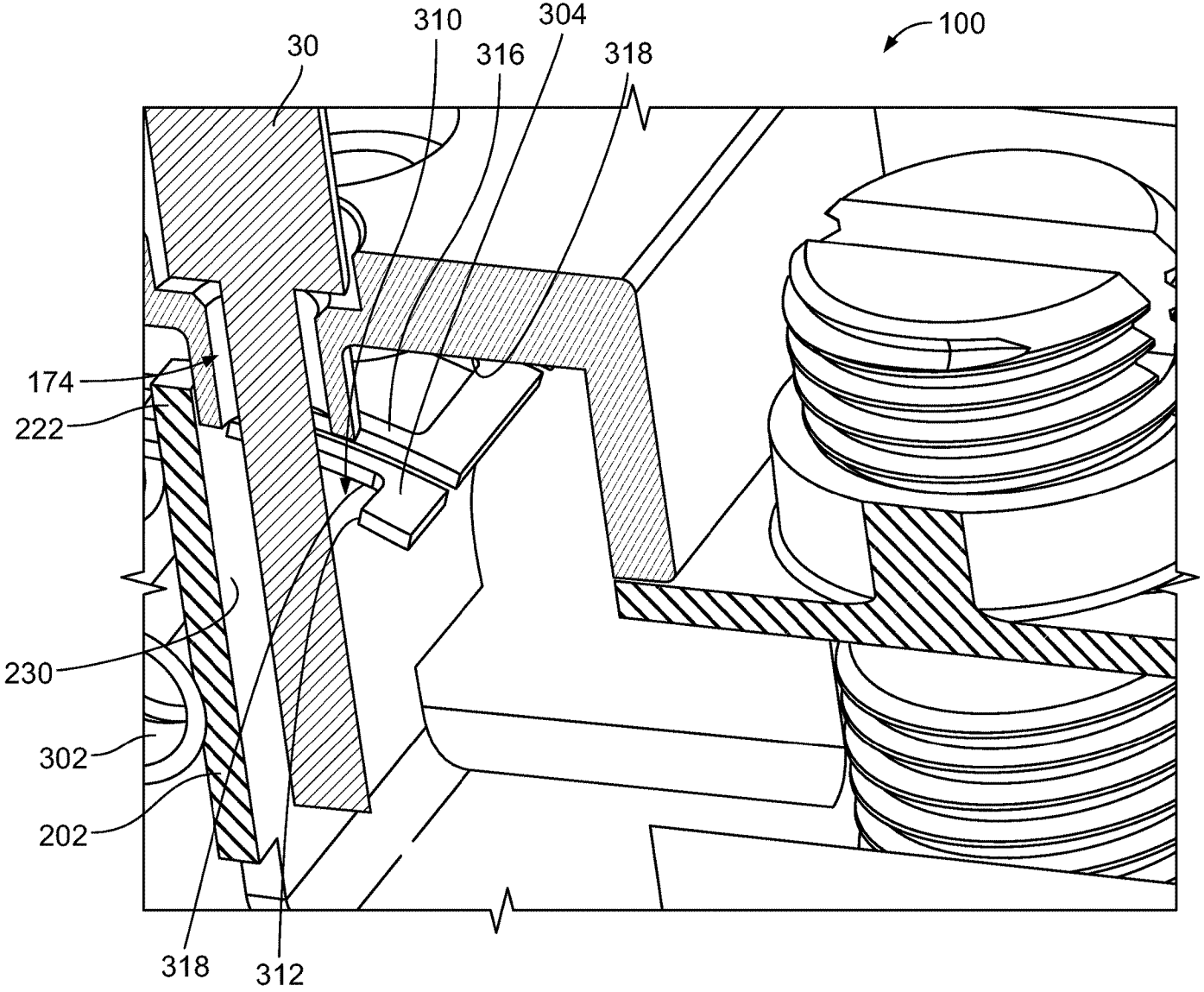
FIG. 12 is a partial sectional view of a portion of the power input terminal block in accordance with an exemplary embodiment.

FIG. 12 is a partial sectional view of a portion of the power input terminal block showing the take-off wire 30 poked into the power input terminal block 100. The spring beam 302 and the cap 304 are pushed forward to the released position. The poke-in window 310 is aligned with the poke-in wire opening 174 to receive the take-off wire 30. The front edge 312 is moved forward away from the contact locating finger 222 allowing the take-off wires 30 to be loaded into the poke-in window 310. The take-off wire 30 passes through the poke-in window 310 and extends along the wire side 230 of the take-off tab 202. The contact locating finger 222 is located in the poke-in window 310. The side edges 316, 318 of the cap 304 extend along sides of the contact locating finger 222 to center or position the cap 304 relative to the take-off tab 202, which retains the poke-in window 310 in alignment with the poke-in wire opening 174.

Figure 13:
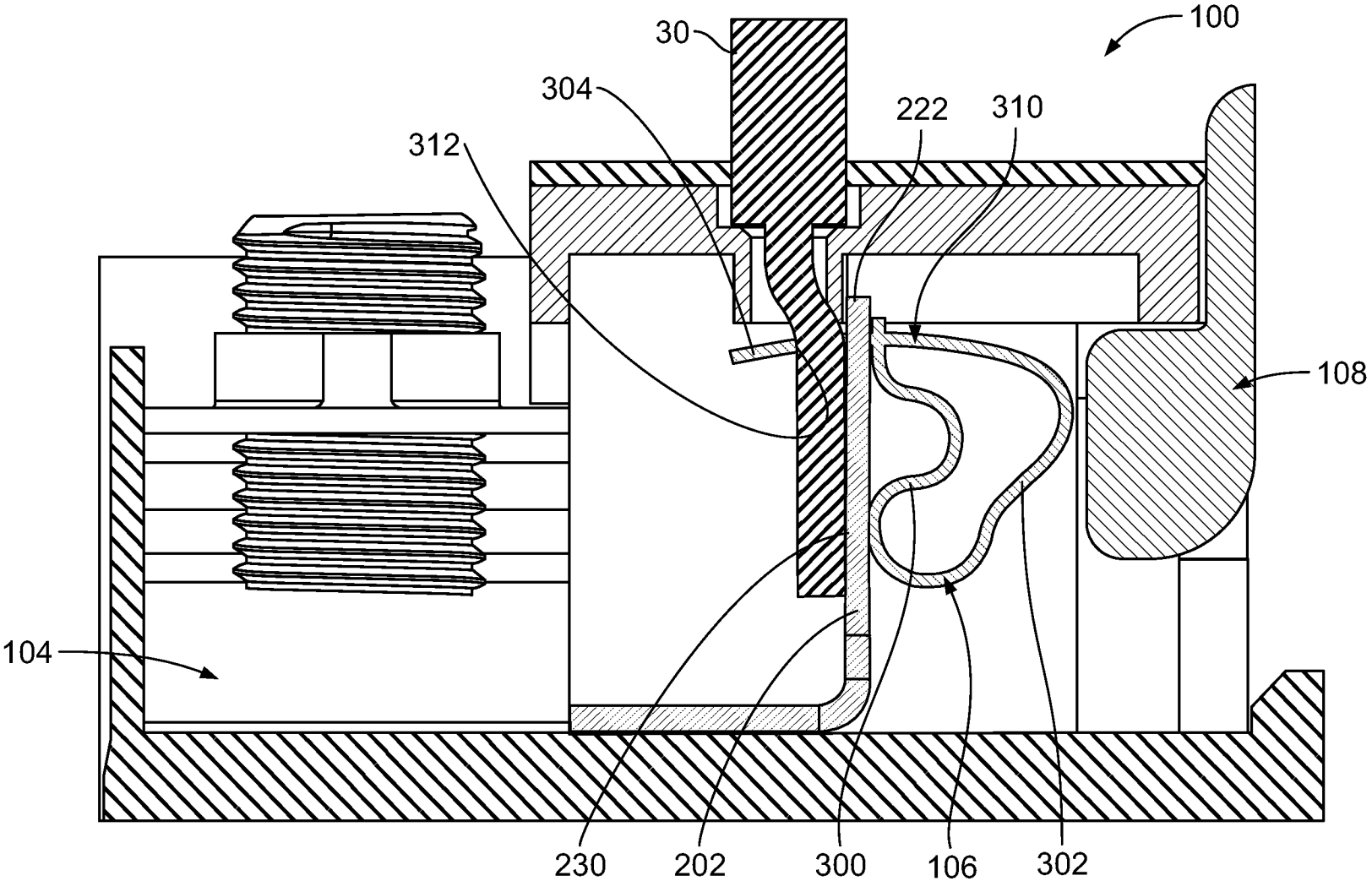
FIG. 13 is a cross-sectional view of a portion of the power input terminal block in accordance with an exemplary embodiment.

FIG. 13 is a cross-sectional view of a portion of the power input terminal block showing the take-off wire 30 poked into the power input terminal block 100. The release lever 108 is illustrated in a closed or unactuated position released from the spring beam 302 of the clamp contact 106. The release lever 108 is released from the clamp contact 106 to allow the clamp contact 106 to clamp against the take-off wire 30 to mechanically and electrically connect the take-off wire 30 to the clamp contact 106 and the terminal 104. The spring beam 302 pulls the cap 304 rearward when the spring beam 302 is released from the release lever 108. The front edge 312 engages the take-off wire 30 pulls the take-off wire 30 rearward against the wire side 230 of the take-off tab 202. As such, the clamp contact 106 clamps that take-off wire 30 in direct electrical contact with the terminal 104, such as at the wire side 230 of the take-off tab 202. The take-off wire 30 is captured between the contact locating finger 222 and the front edge 312 of the poke-in window 310. The take-off wire 30 is captured in the power input terminal block 100 by the clamp contact 106. The front edge 312 digs into the take-off wire 30 to retain the take-off wire 30 in the power input terminal block 100.

In an exemplary embodiment, the release lever 108 may be operated or actuated to again release the clamp contact 106 from the take-off wire 30. For example, the cap 304 is releasable from the conductor of the take-off wire 30, because the connection is at a separable interface. The conductor of the take-off wire is separable from the wire side 230 of the take-off tab 202 because the connection is at a separable interface. In an exemplary embodiment, each clamp contact 106 includes a plurality of the spring beams 302 and the caps 304 for receiving a plurality of the take-off wires 30 to electrically connect multiple take-off wires 30 to the take-off tab 202. The base 300 electrically commons each of the corresponding spring beams 302 and the caps 304 to electrically common the take-off wires 30 with the clamp contact.

Figure 14:
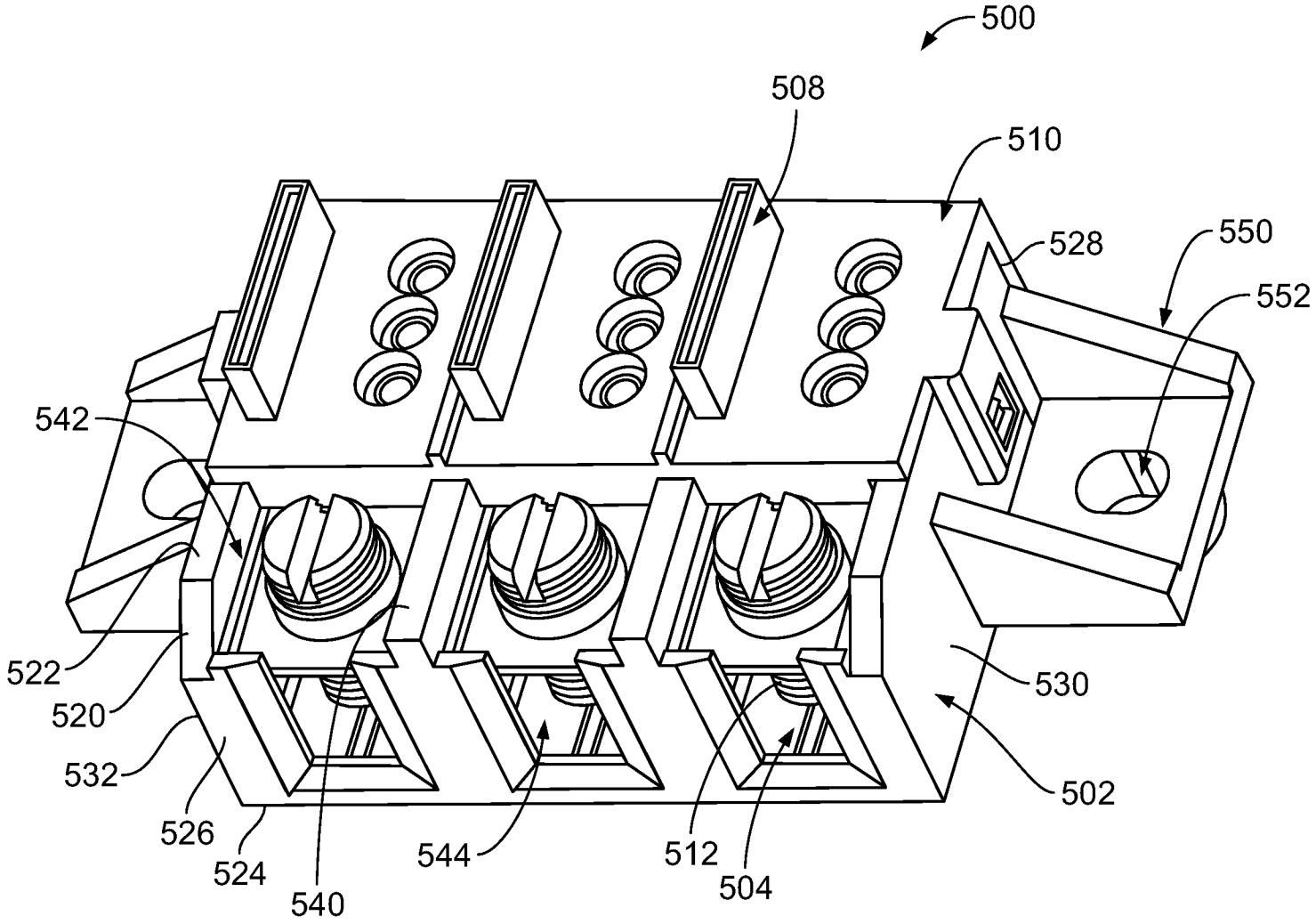
FIG. 14 is a top perspective view of a power input terminal block in accordance with an exemplary embodiment.

FIG. 14 is a top perspective view of a power input terminal block 500 in accordance with an exemplary embodiment. The power input terminal block 500 includes a housing 502, terminals 504, clamp contacts 506, release levers 508, and a cover 510 coupled to the housing 502 covering the terminals 504, the clamp contacts 506, and/or the release levers 508. The power input terminal block 500 is similar to the power input terminal block 100 and may be used in the light fixture 12. The power input terminal block 500 receives the take-off wires 30 in a different orientation and the clamp contacts 506 and terminals 504 are modified compared to the clamp contacts 106 and the terminals 104 to receive the take-off wires 30 in such orientation. The release levers 108 are modified to interface with the modified clamp contacts 506.

In an exemplary embodiment, the power input terminal block 500 is configured to receive the supply wires 20 (shown in FIG. 1) and is configured to receive the take-off wires 30. In an exemplary embodiment, the take-off wires 30 are configured to be poked into the power input terminal block 500 for quick assembly and electrical connection. As such, the take-off wires 30 are separable from the power input terminal block 500, such as for rewiring, repair, or replacement. The take-off wires 30 may be quickly and easily connected to the power input terminal block 500. In an exemplary embodiment, the release levers 508 are used to release the clamp contacts 506 to allow insertion and removal of the take-off wires 30 without damaging the take-off wires 30 other components of the power input terminal block 500, such as the clamp contacts 506 and/or the terminals 504. In the illustrated embodiment, the take-off wires 30 are loaded through openings in the cover 510 for termination to the clamp contacts 506 in the terminals 504. Optionally, each terminal 504 is used to power multiple take-off wires 30.

The housing 502 includes a plurality of walls 520 defining the housing 502. The housing 502 extends between a top 522 and a bottom 524. The housing 502 includes a front 526 and the rear 528. The housing 502 includes a first side 530 and a second side 532 opposite the first side 530. The walls 520 may include a top wall, a bottom wall, a front wall, a rear wall, a first side wall, a second side wall, or other walls.

In an exemplary embodiment, the housing 502 includes separating walls 540 separating terminal channels 542 that receive corresponding terminals 504. The terminal channels 542 may be open at the top 522 and/or the front 526 to receive the terminals 504. In an exemplary embodiment, the cover 510 is coupled to the top 522 of the housing 502 to close the terminal channels 542 and retain the terminals 504 in the terminal channels 542. In an exemplary embodiment, the housing 502 includes wire openings 544 at the front 526 that receive corresponding supply wires 20. The supply wires 20 may be loaded through the wire openings 544 into the terminals 504. The supply wires 20 may be mechanically and electrically connected to the terminals 504 using set screws 512

In an exemplary embodiment, the housing 502 includes mounting tabs 550 used for mounting the power input terminal block 500 to a structure, such as the fixture housing 16 (shown in FIG. 1). In the illustrated embodiment, the mounting tabs 550 are provided at the first side 530 and the second side 532. Other positions are possible in alternative embodiments, such as the bottom 524, the front 526 and/or the rear 528. Each mounting tab 550 includes an opening 552 configured to receive a fastener (not shown), such as a threaded fastener. The mounting tabs 550 may be secured to the mounting structure by other means in alternative embodiments.

Figure 15:
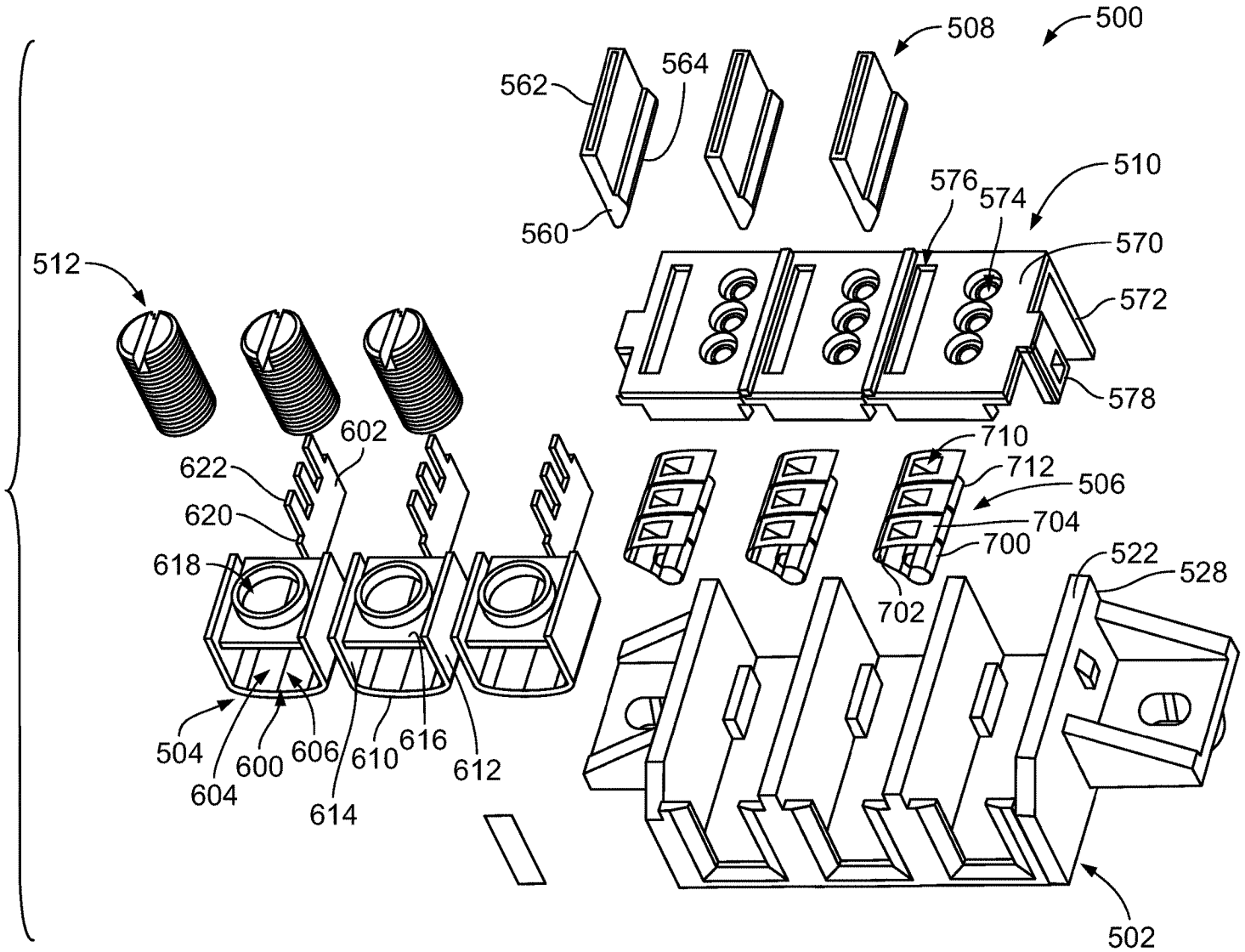
FIG. 15 is a front exploded view of the power input terminal block in accordance with an exemplary embodiment.

FIG. 15 is a front exploded view of the power input terminal block 500 in accordance with an exemplary embodiment. FIG. 15 illustrates the housing 502, the terminals 504, the clamp contacts 506, the release levers 508, and the cover 510. The terminals 504 in the clamp contacts 506 are configured to be loaded into the housing 502 through the top 522 of the housing 502.

In an exemplary embodiment, each of the terminals 504 are identical; however, the terminals 504 may include different features in alternative embodiments. Each terminal 504 includes a main body 600 and a take-off tab 602 extending from the main body 600. The main body 600 defines a wire pocket 604 configured to receive a corresponding supply wire 20. In an exemplary embodiment, the main body 600 includes an end wall 610, a first side wall 612, a second side wall 614, and a set screw wall 616. The set screw wall 616 may be integral with the other walls or may be separate and discrete from the other walls of the main body 600. In various embodiments, the end wall 610 is nonplanar forming a cradle 606 at the bottom of the wire pocket 604 that receives the supply wire 20. The cradle 606 helps to center the supply wire 20 in the wire pocket 604. The side walls 612, 614 extend from the end wall 610. The set screw wall 616 may extend from the first side wall 612 or the second side wall 614. In an exemplary embodiment, the main body 600 is stamped and formed. The set screw wall 616 has a set screw opening 618 that receives the set screws 512. The set screw opening 618 may be a threaded bore in various embodiments.

The take-off tab 602 extends rearward from the main body 600. For example, the take-off tab 602 may extend from the end wall 610, being bent or formed to be an upstanding take-off tab 602. In various embodiments, the take-off tab 602 may be parallel to the loading direction of the supply wire 20 into the wire pocket 604. In an exemplary embodiment, the terminal 504 is a monolithic, unitary structure. In an exemplary embodiment, the take-off tab 602 extends to an outer edge 620. The take-off tab 602 includes one or more contact locating fingers 622 extending from the outer edge 620. The contact locating fingers 622 are configured to be received in the clamp contacts 506, such as in poke-in windows of the clamp contacts 506.

In an exemplary embodiment, each clamp contact 506 is identical. However, the clamp contacts 506 may have different features in alternative embodiments. Each clamp contact 506 includes a base 700, one or more spring beams 702 extending from the base 700, and one or more caps 704 extending from the corresponding spring beams 702. The base 700 is configured to be coupled to the terminal 504, such as the take-off tab 602. The base 700 may have multiple points of contact with the take-off tab 602. Each cap 704 is used to mechanically and electrically connect to the corresponding take-off wire 30. For example, the take-off wires 30 may be poked into the caps 704. The spring beams 702 allow the caps 704 to move relative to the base 700 for mating to and unmated from the take-off wires 30. In the illustrated embodiment, the clamp contact 506 includes three spring beams 702 and three caps 704 are provided at the ends of the spring beams 702. The spring beams 702 are independently movable relative to each other. The spring beams 702 are deflectable, such as to release the clamp contact 506 from the take-off wires 30.

In an exemplary embodiment, the clamp contact 506 are configured to be clipped onto the take-off tabs 602. The base 700 is configured to be electrically connected to the take-off tab 602. In an exemplary embodiment, each cap 704 includes a poke-in window 710 that receives the corresponding take-off wire 30. The take-off wire 30 is releasably received in the poke-in window 710. The cap 704 may be released from the take-off wire 30 to allow the take-off wire 30 to be removed from the power input terminal block 500. For example, the release lever 508 may be used to release the cap 704 from the take-off wire 30. The poke-in window 710 is defined by edges 712. When the clamp contact 506 is clamped to the take-off wire 30, the edge 712 presses against the take-off wire 30 to electrically connect the clamp contact 506 to the take-off wire 30. The take-off wire 30 is configured to be pressed against the take-off tab 602 by the edge 712 of the poke-in window 710.

In an exemplary embodiment, each release lever 508 is identical; however, the release levers 508 may include different features in alternative embodiments. In an exemplary embodiment, the release levers 508 are configured to be coupled to the cover 510. For example, the release levers 508 may be slidably coupled to the cover 510. In the illustrated embodiment, the release levers 508 are slidable in downward directions, however, the release levers 508 may be slidable in other directions. Each release lever 508 includes a main body 560 and a handle 562 extending from the main body 560. The handle 562 is configured to be actuated to move the main body 560 into contact with the clamp contact 506 to release the clamp contact 506. For example, the handle 562 may be pressed downward to move the main body 560 into contact with the clamp contact 506. In an exemplary embodiment, the main body 560 includes a releasing surface 564 configured to engage the clamp contact 506 and release the clamp contact 506.

The cover 510 is configured to be coupled to the housing 502. In an exemplary embodiment, the cover 510 includes a main wall 570 and an end wall 572 extending from the main wall 570. The main wall 570 is configured to extend across the top 522 of the housing 502. The end wall 572 is configured to extend along the rear 528 of the housing 502. In the illustrated embodiment, the main wall 570 includes windows 576 that receive the release levers 108. In an exemplary embodiment, the cover 510 includes poke-in wire openings 574 in the main wall 570. The poke-in wire openings 574 receive corresponding take-off wires 30 as the take-off wires 30 are poked into the power input terminal block 500. The poke-in wire openings 574 are configured to be aligned with corresponding clamp contact 506 and poke-in windows 710 to receive the take-off wires 30. In an exemplary embodiment, the cover 510 includes latches 578 configured to be coupled to the housing 502 to secure the cover 510 to the housing 502. Other securing means, such as fasteners, may be used in alternative embodiments.

Figure 16:
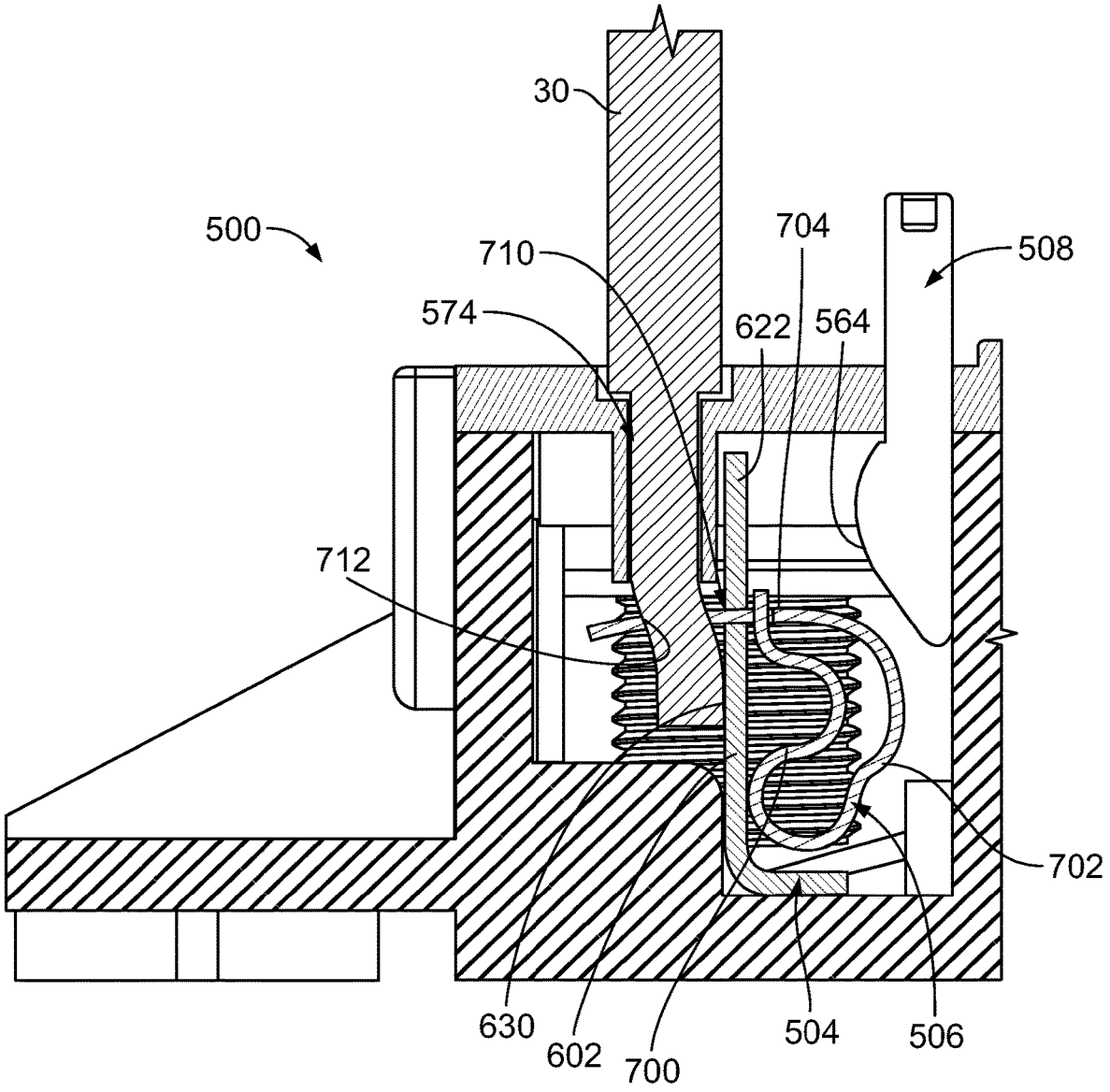
FIG. 16 is a cross-sectional view of a portion of the power input terminal block in accordance with an exemplary embodiment.

FIG. 16 is a cross-sectional view of a portion of the power input terminal block 500 showing one of the take-off wires 30 loaded into the power input terminal block 500. The take-off wires 30 is received in the poke-in wire opening 574. The release lever 508 is unactuated, allowing the clamp contact 506 to engage the take-off wire 30. The release lever 508 may be actuated to engage the spring beam 702 of the clamp contact 506 and release the clamp contact 506 from the take-off wire 30, such as to release the take-off wire 30. For example, the releasing surface 564 may be pressed downward into the spring beam 702 to push the spring beam 702 and the cap 704 forward to a released position.

The release lever 508 is illustrated in a closed or unactuated position released from the spring beam 702 of the clamp contact 506. The release lever 508 is released from the clamp contact 506 to allow the clamp contact 506 to clamp against the take-off wire 30 to mechanically and electrically connect the take-off wire 30 to the clamp contact 506 and the terminal 504. The spring beam 702 pulls the cap 704 toward the take-off wire 30 when the spring beam 702 is released from the release lever 508. The edge 712 engages the take-off wire 30 and pulls the take-off wire 30 against the wire side 630 of the take-off tab 602. As such, the clamp contact 506 clamps that take-off wire 30 in direct electrical contact with the terminal 504, such as at the wire side 630 of the take off tab 602. The take-off wire 30 is captured between the contact locating finger 622 and the edge 712 of the poke-in window 710. The take-off wire 30 is captured in the power input terminal block 500 by the clamp contact 506. The edge 712 digs into the take-off wire 30 to retain the take-off wire 30 in the power input terminal block 500.

In an exemplary embodiment, the release lever 508 may be operated or actuated to again release the clamp contact 506 from the take-off wire 30. For example, the cap 704 is releasable from the conductor of the take-off wire 30, because the connection is at a separable interface. The conductor of the take-off wire is separable from the wire side 630 of the take-off tab 602 because the connection is at a separable interface. In an exemplary embodiment, each clamp contact 506 includes a plurality of the spring beams 702 and the caps 704 for receiving a plurality of the take-off wires 30 to electrically connect multiple take-off wires 30 to the take-off tab 602. The base 700 electrically commons each of the corresponding spring beams 702 and the caps 704 to electrically common the take-off wires 30 with the clamp contact.

Figure 17:
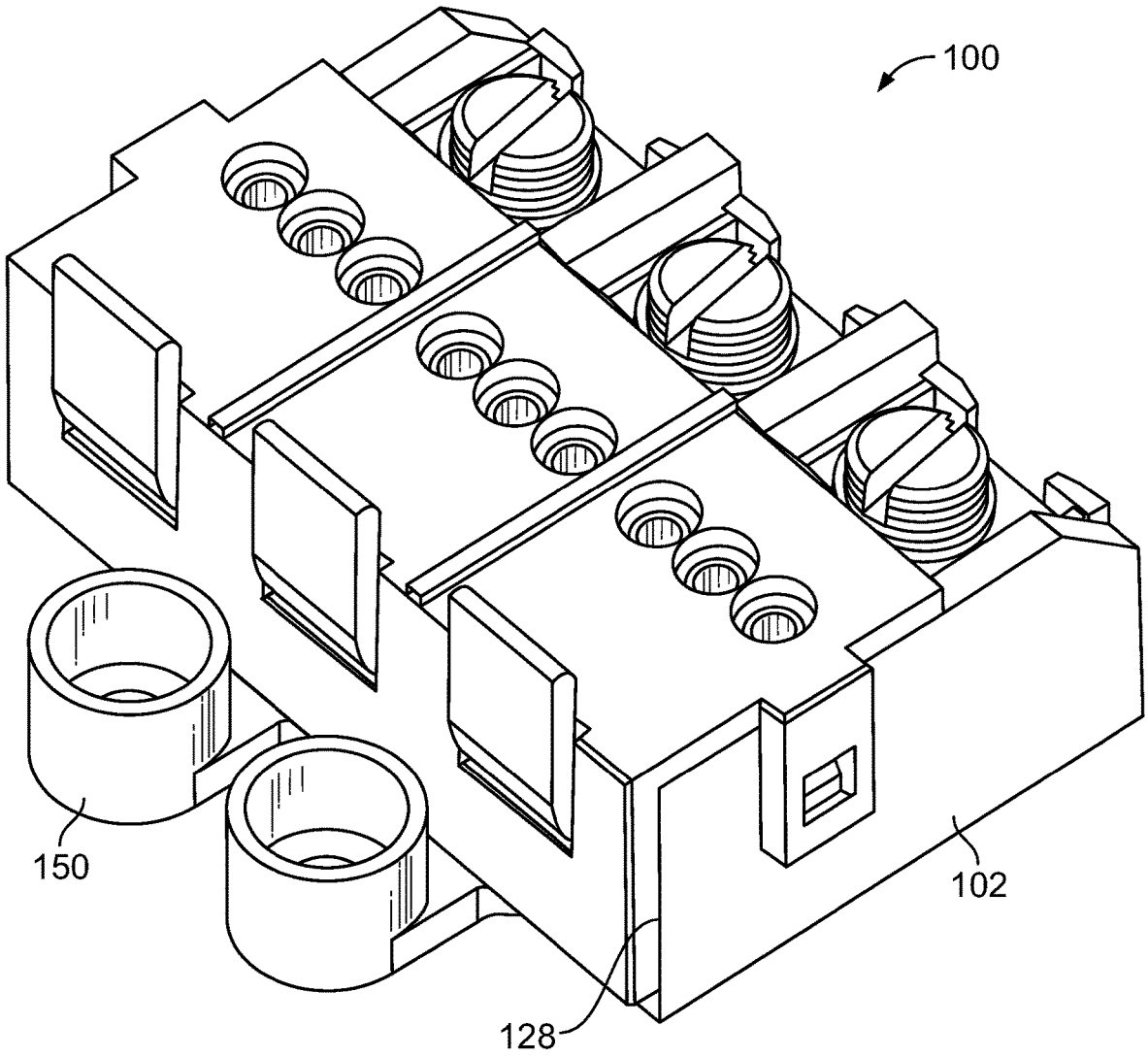
FIG. 17 is a top perspective view of the power input terminal block in accordance with an exemplary embodiment.

FIG. 17 is a top perspective view of the power input terminal block 100 in accordance with an exemplary embodiment. FIG. 17 shows the power input terminal block 100 with the mounting tabs 150 in an alternative location, such as at the rear 128 of the housing 102. Other locations are possible in alternative embodiments.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A power input terminal block comprising:

a housing including terminal channels with separating walls between the terminal channels;

terminals received in the terminal channels, each terminal including a main body defining a wire pocket and a set screw wall adjacent the wire pocket holding a set screw movably received in the wire pocket to retain a supply wire in the wire pocket, each terminal including a take-off tab electrically connected to the main body, the take-off tab having a wire side configured to receive a take-off wire;

clamp contacts separate and discrete from the terminals and received in the terminal channels, the clamp contacts coupled to the take-off tabs of the corresponding terminals, each clamp contact having a base coupled to the take-off tab and a spring beam extending from the base, each clamp contact having a cap extending from the spring beam, the cap including a poke-in window configured to receive the take-off wire, the cap including an edge defining the poke-in window, the edge engaging the take-off wire and pulling the take-off wire against the wire side of the take-off tab; and release elements coupled to the housing, each release element including a releasing surface operably coupled to the spring beam of the corresponding clamp contact to move the spring beam to an extended position to allow loading and removal of the take-off wire from the clamp contact and the take-off tab;

wherein each clamp contact includes a plurality of the spring beams and caps for receiving a plurality of the take-off wires to electrically connect the plurality of the take-off wires to the take-off tab, the base electrically commoning each of the corresponding spring beams and the caps to electrically common the take-off wires with the clamp contact.

2. The power input terminal block of claim 1, wherein each cap is releasable from a conductor of the corresponding take-off wire at a separable interface and wherein the conductor of the take-off wire is separable from the wire side of the take-off tab at a separable interface.

3. The power input terminal block of claim 1, wherein each clamp contact is a stamped and formed contact having the base, the spring beam and the cap integral as a monolithic, unitary structure having a common thickness at the base, the spring beam and the cap.

4. The power input terminal block of claim 1, wherein each terminal is a stamped and formed contact having the main body and the take-off tab integral as a monolithic, unitary structure having a common thickness at the main body and at the take-off tab.

5. The power input terminal block of claim 1, wherein the main body includes an end wall, a first side wall and a second side wall defining the wire pocket, the set screw wall extending between the first side wall and the second side wall, the first and second side walls being stamped and formed with the end wall.

6. The power input terminal block of claim 5, wherein the set screw wall is stamped and formed with the first and second side walls and with the end wall.

7. The power input terminal block of claim 1, wherein the end wall is non-planar including a cradle between the first and second walls configured to retain the supply wire therein.

8. The power input terminal block of claim 1, wherein the take-off tab includes a contact locating finger extending from an edge of the take-off tab, the contact locating finger being received in the poke-in window, the take-off wire being captured between the contact locating finger and the edge of the poke-in window.

9. The power input terminal block of claim 1, further comprising a cover coupled to the housing, the cover including a main wall covering the terminal channels, the main wall including poke-in openings aligned with the poke-in windows to receive the take-off wires and electrically connect the take-off wire to the take-off tab.

10. The power input terminal block of claim 9, wherein each clamp contact includes poke-in windows in the caps, the cover including a plurality of the poke-in openings aligned with each clamp contact to receive a plurality of the take-off wires in the poke-in windows to electrically connect a plurality of the take-off wires with each take-off tab.

11. The power input terminal block of claim 1, wherein the release elements are rotatably coupled to the housing to move between an actuated position and an unactuated position.

12. The power input terminal block of claim 1, wherein the release elements are slidably coupled to a cover coupled to the housing to move between an actuated position and an unactuated position.

13. The power input terminal block of claim 1, wherein each release elements includes a releasing surface configured to engage the spring beam of the corresponding clamp contact to release the clamp contact from the take-off wire.

14. The power input terminal block of claim 1, wherein each base includes at least two points of contact with a contact side of the take-off tab opposite the wire side of the take-off tab.

15. A power input terminal block comprising:

a housing including terminal channels with separating walls between the terminal channels;

terminals received in the terminal channels, each terminal being stamped and formed from a terminal body to include a main body and a take-off tab, the main body defining a wire pocket and a set screw wall adjacent the wire pocket holding a set screw movably received in the wire pocket to retain a supply wire in the wire pocket, the take-off tab having a wire side configured to receive a take-off wire, the take-off tab being integral with the main body as a monolithic, unitary structure;

clamp contacts separate and discrete from the terminals and received in the terminal channels, the clamp contacts coupled to the take-off tabs of the corresponding terminals, each clamp contact having a base coupled to the take-off tab and a spring beam extending from the base, each clamp contact having a cap extending from the spring beam, the cap including a poke-in window configured to receive the take-off wire, the cap including an edge defining the poke-in window, the edge engaging the take-off wire and pulling the take-off wire against the wire side of the take-off tab; and release elements coupled to the housing, each release element including a releasing surface operably coupled to the spring beam of the corresponding clamp contact to move the spring beam to an extended position to allow loading and removal of the take-off wire from the clamp contact and the take-off tab;

wherein each clamp contact includes a plurality of the spring beams and caps for receiving a plurality of the take-off wires to electrically connect the plurality of the take-off wires to the take-off tab, the base electrically commoning each of the corresponding spring beams and the caps to electrically common the take-off wires with the clamp contact.

16. The power input terminal block of claim 15, wherein each cap is releasable from a conductor of the corresponding take-off wire at a separable interface and wherein the conductor of the take-off wire is separable from the wire side of the take-off tab at a separable interface.

17. The power input terminal block of claim 15, wherein each clamp contact is a stamped and formed contact having the base, the spring beam and the cap integral as a monolithic, unitary structure having a common thickness at the base, the spring beam and the cap.

18. A power input terminal block comprising:

a housing including terminal channels with separating walls between the terminal channels;

terminals received in the terminal channels, each terminal including a main body defining a wire pocket and a set screw wall adjacent the wire pocket holding a set screw movably received in the wire pocket to retain a supply wire in the wire pocket, each terminal including a take-off tab electrically connected to the main body, the take-off tab having a wire side configured to receive a plurality of take-off wires;

clamp contacts coupled to the take-off tabs of the corresponding terminals, each clamp contact having a base coupled to the take-off tab and a plurality of spring beams extending from the base, the spring beams having caps at distal ends of the spring beams, the caps including poke-in windows configured to receive the take-off wires, the poke-in windows defined be wire edges configured to engage the take-off wires and pull the take-off wires against the wire side of the take-off tab, the base of each clamp contact electrically commoning the corresponding take-off wires; and release elements coupled to the housing, each release element including a releasing surface operably coupled to the spring beams of the corresponding clamp contacts to move the spring beams to extended positions to allow loading and removal of the take-off wires from the clamp contacts and the take-off tabs.

19. The power input terminal block of claim 18, wherein each cap is releasable from a conductor of the corresponding take-off wire at a separable interface and wherein the conductor of the take-off wire is separable from the wire side of the take-off tab at a separable interface.

* * * * *